US012331431B2

(12) United States Patent
Meyer et al.

(10) Patent No.: US 12,331,431 B2
(45) Date of Patent: Jun. 17, 2025

(54) MODULE FOR A FIBER PREPARATION MACHINE AND FIBER PREPARATION MACHINE

(71) Applicant: Maschinenfabrik Rieter AG, Winterthur (CH)

(72) Inventors: Pascal Meyer, Winterthur (CH); Lukas Braun, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 446 days.

(21) Appl. No.: 17/680,600

(22) Filed: Feb. 25, 2022

(65) Prior Publication Data

US 2022/0275540 A1 Sep. 1, 2022

(30) Foreign Application Priority Data

Feb. 26, 2021 (CH) ..... 00211/21

(51) Int. Cl.
*D01H 5/16* (2006.01)

(52) U.S. Cl.
CPC ..... *D01H 5/16* (2013.01)

(58) Field of Classification Search
CPC .. D01H 5/16; D01H 5/12; D01H 5/02; D01H 5/00; D01G 7/12; D01G 7/00; D01G 7/06; D01G 13/00; D01G 15/32; D01G 15/12; D01G 15/02; D01G 15/00; D01G 9/20; D01G 9/14; D01G 9/00; F16M 1/08; F16M 1/00; F16B 5/0208
See application file for complete search history.

(56) References Cited

U.S. PATENT DOCUMENTS 3,936,995 A * 2/1976 Laflaquiere ..... D01H 1/16 57/1 R
4,255,925 A * 3/1981 Marzoli ..... D01H 1/168 57/1 R
4,332,129 A * 6/1982 Schipper ..... B65H 54/20 57/1 R
4,856,752 A * 8/1989 Linn ..... F16M 1/08 29/527.1

(Continued)

FOREIGN PATENT DOCUMENTS

CN 105 177 771 A 12/2015
CN 105177771 * 12/2015

(Continued)

OTHER PUBLICATIONS

Swiss Patent Office Search Report, Jun. 3, 2021.

*Primary Examiner* — Uyen T Nguyen
(74) *Attorney, Agent, or Firm* — Dority & Manning, P.A.

(57) ABSTRACT

A module for a fiber preparation machine is a self-supporting element having a cuboid shape with a length (L), a width (B) and a height (H), as well as at least two lateral walls extending in parallel respective planes and spaced apart by the width (B). A cross beam connects the lateral walls to one another. Each of the lateral walls is encompassed by a frame. A first leg of the frame is arranged along the plane of the respective lateral wall and a second leg of the frame is arranged at a right angle to the lateral wall and facing away from the opposite lateral wall. A fiber preparation machine includes a plurality of the modules interconnected together.

13 Claims, 5 Drawing Sheets

(56) References Cited

U.S. PATENT DOCUMENTS

| | | | | | |
|---|---|---|---|---|---|
| 5,421,150 | A * | 6/1995 | Adolf | D01H 1/16 | 57/406 |
| 2012/0163940 | A1* | 6/2012 | Westrick | B60P 1/00 | 410/52 |
| 2014/0361030 | A1* | 12/2014 | Toba | B65D 81/02 | 399/110 |

FOREIGN PATENT DOCUMENTS

| | | | |
|---|---|---|---|
| CN | 106 283 277 | A | 1/2017 |
| DE | 10 2015 000 490 | A1 | 7/2016 |
| DE | 10 2016 109 535 | A1 | 11/2017 |
| DE | 102016109535 | * | 11/2017 |
| GB | 591 540 | A | 8/1947 |
| GB | 591540 | * | 8/1947 |

* cited by examiner

MODULE FOR A FIBER PREPARATION MACHINE AND FIBER PREPARATION MACHINE

FIELD OF THE INVENTION

The invention relates to a module for a fiber preparation machine, as well as to a fiber preparation machine consisting of modules.

BACKGROUND

In today's mechanical engineering, machines are usually designed having a machine housing, a machine frame or a machine body. All components or elements of the machine are fastened to this machine frame and held thereon in a non-rotatable or rotatable manner. In addition, casing elements are also held by this machine frame in order to protect the machines or the operating personnel. Due to this construction, each machine type has its own machine frame. Although different fastenings can be provided in a machine frame in order to install additional or optional elements in the machine frame, in principle the machine cannot be expanded or converted into a different machine type without great effort and complexity. In the case of larger machines, their machine frames are also disassembled for transport and then reassembled, with a complicated connection usually being provided to ensure the functionality of the machine and reliable interaction of the machine components. A way of constructing machines in individual machine modules is also known from the prior art. A machine is composed of different modules, with different modules also being put in at the same place for different functions. However, the structure of the modules is adapted to the relevant function of the built-in components. As a result, the modules form self-contained functional units which can be interchanged with one another.

In a fiber preparation system in a spinning mill, supplied fibers or fiber clusters are prepared for use in a spinning machine. In a fiber preparation system, the fibers to be prepared for spinning pass through a plurality of processing stages.

In a first stage, the fibers are removed from fiber bales in the form of fiber flocks. What are referred to as bale openers are usually used for this purpose. These fiber flocks are transported out of the bale opener by means of pneumatic flock conveyance and, for example, transferred to a downstream cleaning machine. In the further stages, the fiber preparation system also has a sequence of cleaning machines, storage machines and mixing machines through which the fibers or fiber flocks pass. The sequence and design of the fiber preparation machines are adapted to the fibers to be processed and are used for cleaning, mixing, and separating the fiber flocks into individual fibers and making them parallel. The individual machines in a fiber preparation system can be arranged in different ways, this being dependent, inter alia, on the raw material to be processed and the product to be obtained. The structure of the individual fiber preparation machines is also adapted to the raw material to be processed and the product to be obtained. The fiber preparation machines also differ depending on the production level that is to be achieved in fiber preparation. The fiber preparation machines used are, for example, coarse cleaners, fine cleaners, foreign part separators, storage units and mixers as well as carders or cards. Due to the dimensions of fiber preparation machines, it is not possible to construct the entire machine using a stiffened construction that can be transported as a ready-to-use machine. Such a construction is used for draw frames, for example, as described in DE 10 2016 109 535 A1. In contrast, the dimensions of fiber preparation machines far exceed the sizes of the containers usually available for transport.

A simplification of the construction was proposed in GB 591,540 A, in which uniform wall elements are used that are joined together with angle iron. The lateral walls are then stiffened against one another using cross beams and the upper cover metal sheets are attached. Corresponding openings are provided in the lateral walls for the necessary built-in components. Once the machine is constructed, the standardized lateral walls cannot be replaced or changed without endangering the stability of the machine.

The disadvantage of known constructions is that the construction of a fiber preparation machine at its place of use or a later expansion or enlargement or reduction of the fiber preparation machine is complex. Furthermore, in a modular construction known today, the dimensions of the individual modules are adapted to their function due to the formation of modular functional units. This has the disadvantage that no standardized expansion is possible.

SUMMARY

An object of the invention is therefore that of providing a device which makes simple construction of machine modules possible and, through its standardization, is conducive to a uniformly modular construction of fiber processing machines. Additional objects and advantages of the invention will be set forth in part in the following description, or may be obvious from the description, or may be learned through practice of the invention.

A new type of module for a fiber preparation machine is proposed, the module being cuboid and having a length, a width and a height. The module is designed as a self-supporting element and has at least two lateral walls which are spaced apart in width, are arranged in a plane in each case, and are connected to one another by at least one cross beam, the planes of the lateral walls being parallel to one another and the lateral walls being encompassed by a frame in each case. A first leg of the frame is arranged in the plane of the lateral wall in each case and a second leg of the frame is arranged in each case at right angles facing away from the relevant opposite lateral wall. This construction of the individual modules achieves a standardization which allows a simplification in the assembly of the modules. In addition, a stable and self-supporting element is provided which, in its basic structure, can be used for the simple design of a wide variety of modules. The frame stabilizes the lateral walls and it is possible to line up or stack the modules because the frames form a solid contact. A self-supporting element can be understood to mean that the module designed in this way can be moved or lifted without additional reinforcement or an additional transport aid. The module can be gripped at and moved to predetermined positions. A module designed as a self-supporting element is inherently stable and torsion-resistant in such a way that deformations or changes in shape do not occur during transport and assembly.

The frames are at least partly connected to the lateral wall or are partly formed by the lateral wall itself. For example, simple angle irons (isosceles or not isosceles) can be attached to the lateral wall from one side and screwed, welded or glued to said wall. In an alternative embodiment, the lateral wall itself forms the first leg, the second leg being formed by flat steel bars attached orthogonally to the lateral wall. The flat steel bars can be supported against the lateral wall by means of additional ribs. A connection by welding or gluing is recommended. In a further alternative embodiment, an angle iron is not attached to the lateral wall, but rather welded to the outer edge of the lateral wall. The use of U-profiles as a frame is also conceivable. In all variations, additional connecting means or corresponding ribbing can be placed into the lateral wall due to the high loads. The thickness of the lateral wall and the frame is also to be selected on the basis of the provided built-in components or an anticipated surface load. For example, in the case of a built-in roller, a reinforcement of the lateral wall or attached ribs can achieve a uniform introduction of the bearing and drive forces into the lateral wall.

The connection of two lateral walls with at least one cross beam ensures that two lateral walls together with their frame in each case form a module of a certain width. The length and height of a module are determined by the dimensions of the lateral walls or the frame. The length and width of a module can vary from module to module depending on the built-in components or the intended use. For example, a basic module on which the machine is constructed can have a lower height than a module which forms part of a storage unit.

The modules do not necessarily have to be made of a material such as steel. The proposed construction in the form of a self-supporting element makes a combination of materials possible. The lateral walls can be made of plastics material and the frame can be made of steel. In the case of simple end modules that are exposed to a low static or dynamic load, the frame and lateral wall can also be made of plastics material, with the option of an integral design.

The frame is advantageously formed by flat steel bars or an angle iron or a U-profile. The frames are at least partly connected to the lateral wall or are partly formed by the lateral wall itself. For example, simple angle irons (isosceles or not isosceles) can be attached to the lateral wall from one side and screwed, welded or glued to said wall. In an alternative embodiment, the lateral wall itself forms the first leg, the second leg being formed by flat steel bars attached orthogonally to the lateral wall. The flat steel bars can be supported against the lateral wall by means of additional ribs. A connection by welding or gluing is recommended. In a further alternative embodiment, an angle iron is not attached to the lateral wall, but rather welded to the outer edge of the lateral wall. The use of U-profiles to form the frame is also an alternative embodiment. In such a construction, a first leg of the U-profile is placed in the plane of the lateral wall in each case or on the lateral wall, a second leg of the U-profile is arranged at right angles facing away from the relevant opposite lateral wall and a third leg is in turn parallel to the plane of the lateral wall in each case.

In all variations, additional connecting means or corresponding ribbing can be placed into the lateral wall due to the high loads. The thickness of the lateral wall and the frame is also to be selected on the basis of the provided built-in components or an anticipated surface load. For example, in the case of a built-in roller, a reinforcement of the lateral wall or attached ribs can achieve a uniform introduction of the bearing and drive forces into the lateral wall.

The at least one cross beam is preferably formed by an angle iron or a pipe or a metal sheet or a roller. Within the meaning of the application, all built-in components between the lateral walls of a module that connect the two lateral walls are to be understood by the term cross beam. For example, baffle plates which are fastened to an angle iron for a fiber flow can be provided in a module, with the angle iron in turn being held on the lateral walls. Alternatively, the module contains a roller, for example a needle roller for processing fiber material, and the roller is rotatably held in each case in the lateral walls in a bearing. For example, metal sheets inserted between the lateral walls, such as a base plate or a rear wall, are inserted. These elements, such as metal sheets, rollers or supports, are used as cross beams in that they connect the lateral walls of a module to one another and thus define the width of the module. In addition, the built-in components achieve a stability and torsional resistance of the module, which each individual module must have as a self-supporting element for transport and assembly.

It has been shown that when considering the system outputs which are common today, the module preferably has a width of 1,200 to 1,800 mm. The mentioned width is to be understood as the clear width between the lateral walls and as a guide value. Depending on the make or manufacturer, the width of the modules can deviate slightly by less than 100 mm. By restricting the width to only two sizes, a variety of necessary modules can be restricted. This means that modules of the same type can be used several times in different fiber preparation machines, which in turn leads to a reduction in production costs. For example, a base module which has a base plate as well as a rear wall can not only be used for a fiber preparation machine, but can also be used as the bottom corner module for different embodiments of fiber preparation machines. For dimensioning the metal sheet thicknesses for the lateral walls, a range of from 1 mm to 6 mm is preferred, from which an appropriate selection is made depending on the application or built-in components. A rather thicker lateral wall is used for a large number of built-in components.

Advantageously, adjacent modules are the same in width and in height or in width and in length. The width of the modules determines the width of the fiber preparation machine. A more extensive standardization of the length or the height in addition to the uniform width increases the compatibility of the various modules. This has the advantage that when a fiber preparation machine is converted, be it due to necessary expansions or a module replacement to introduce technical innovations, no special modules are necessary, but rather a simple standard version can be used. It has been found that a length of from 1,000 mm to 1,500 mm and a height of from 1,000 mm to 1,500 mm for basic modules and a height of from 350 mm to 1,000 mm for other modules are advantageous in most cases. A length of 1,110 mm and a height of one third (370 mm) or two thirds (740 mm) the length is particularly preferred.

To improve a fiber flow, modules which form a shaft are preferably 50 mm to 100 mm narrower in width than the adjacent modules. This can be achieved by enlarging the frame of these modules accordingly so that they are in turn compatible with the surrounding modules. Alternatively, however, a correspondingly closer arrangement of the lateral walls relative to one another or the insertion of a guide or baffle plate is also possible.

A module provided for installation in a fiber transport direction and thus closing off the fiber preparation machine advantageously has a rear wall. Such a configuration of the corresponding modules means that a casing for the fiber preparation machine is integrated directly into the modules and is unnecessary in the form of a separate component. The same procedure is to be used for modules that close the fiber preparation machine at the top. For these end modules, it is advantageous if a metal cover sheet is integrated into the module so that subsequent roofing of the fiber preparation machine is no longer necessary.

The second leg of the frame is preferably connected to the relevant lateral wall in a dust-tight manner. This design of a connection between the frame and the lateral wall makes it possible to dispense with an additional dust-tight casing for the fiber preparation machine. Likewise, dust-tight storage units or processing rooms can be provided in the fiber preparation machine only by arranging the modules accordingly, and further complex built-in components can be dispensed with. The lateral walls of the modules can also be provided with viewing openings or transparent regions at appropriate points. A dust-tight or, in a further development of the invention, airtight connection between the frame and the lateral wall can be achieved, for example, by continuous welding or by inserting a seal. When produced from plastics materials or composites, a dust-tight connection between the frame and the lateral wall can be achieved by an integral design.

At least one lifting arm is preferably provided for transporting the module. Plates and threaded holes for fastening the lifting arm to the frame of the module are attached to the lifting arm and receptacles are provided for a fork of a forklift truck and/or slings or ropes are provided for transport using a crane. Using a lifting arm that is adapted to the modules avoids damage caused by improper handling of the modules, for example distortion of the modules or bulging at lifting points. The lifting arm spans a module in its length and provides the necessary means for the lifting equipment used. The lifting arm is placed on a module, with the lifting beam resting on the legs of the frame on both sides of the module. The plate is attached to a side of the legs opposite the lifting arm and is screwed to the lifting beam, for example, using eye bolts through openings in the frame. By using a plate, a distribution of the forces in the leg of the frame is achieved. As an alternative to the combination of plates and eye bolts, quick-release fasteners, for example rotary fasteners, can also be used that can be pivoted and secured after the lifting arm has been placed on a module under the leg of the frame of the module. Other types of quick-release fasteners known from the prior art and used in logistics can also be used. The lifting arm is advantageously provided in a lightweight construction having recesses distributed over the length of the lifting arm and provided with handles for easy manual handling.

Furthermore, a fiber preparation machine is proposed made of a large number of modules according to the preceding description, the opposite second legs of the frames of the adjacent modules being connected to one another in each case. Since the individual modules are designed as self-supporting elements, linking or stiffening of the connected modules beyond the connection of the frames is not necessary. Because the modules are only connected to one another via their frames, quick and easy assembly is possible. At the same time, the frame construction achieves a high level of stability for the entire fiber preparation machine. A simple conversion based on this modular design makes it possible to adapt the structure of a fiber preparation machine to its use and to change it in a simple manner if the production conditions change. For example, an increase in production can be achieved by installing additional modules to enlarge a storage of a fiber preparation machine.

A working width of the fiber preparation machine preferably corresponds to the width of a module. Fiber preparation machines are usually flowed through by fiber material in one main direction, and the fiber material is processed within the fiber preparation machine between an inlet and an outlet. Seen in this processing direction, a working width is mentioned. If the width of the modules corresponds to the working width of the fiber preparation machine, this has the advantage that the lateral walls of the modules also represent the lateral delimitation of the fiber preparation machine.

The connection of the opposite second legs of the frames of the adjacent modules is preferably a clamp connection. Alternatively, the connection is a screw connection or a weld connection. A clamp connection which, for example, is also a positioning aid, allows the modules to be installed quickly and easily. In the case of a clamp connection, the two frames are pressed against one another using screw or spring connections and are thus held in their position between clamping elements, a clamping element being able to be formed by the one frame. Alternatively, the frames can also simply be screwed together with threaded bolts or at least partly welded. In addition, a clamp or screw connection can also be secured by additional welding in part.

The clamp connection is preferably designed like a clip with locking connecting elements. In the case of a clip-like connection, devices are provided on each of the frames which engage with one another when they are pressed against one another. By placing a module on a module below or next to it, the connections are activated and the modules are braced against one another. Furthermore, clip connections are also possible, which can be inserted as separate devices through openings provided in the frame of the modules. Clip-like means that two elements can be connected by simply joining the elements together without the need for a further work step such as screwing.

The connection between the second legs of the frames of the adjacent modules is advantageously provided with a seal. By using a seal, a dust-tight space is also possible across modules. A manufacturing inaccuracy in the evenness of opposite frames of different modules can also be compensated for in a simple manner with a seal.

Alternatively, a device having connecting elements for connecting and positioning the modules is provided for the connection, a first module having an opening in its frame for receiving a connecting element and a second module having a fastening hole in its frame as well as two positioning notches which are offset from one another by at least 45 annular degrees around the fastening hole. The connecting element in a first position in the first positioning notch is non-rotatably screwed to the second module in the fastening hole in an assembly position and the connecting element in a second position in the second positioning notch is non-rotatably screwed to the second module in the fastening hole in an operating position. The first module is connected to the second module in the operating position by bracing the frame of the first module between the connecting element and the frame of the second module.

The connecting element is advantageously designed to be conical, a cross section of the connecting element tapering toward the first module. The conical design of the connecting element facilitates mutual positioning of the modules to be connected. This means that additional positioning aids such as positioning pins or inlet brackets can be dispensed with. The opening for receiving the connecting element in the frame of the first module can also be set exactly to the largest cross section of the connecting element, so that the modules can be assembled precisely without having to position the modules with millimeter precision prior to the actual assembly. In this way simple lifting means can be used to assemble the modules. The connecting element is fastened in place on the second module, so that only the narrow part of the conical connecting element has to be inserted into the opening of the first module and then, through the tapering cross section of the connecting element, the first module is guided into the exact position when it is moved closer to the second module.

The positioning notches simplify pre-assembly of the connecting element on the frame of the second module. The connecting element can be screwed to the frame of the second module in the exact position without measuring equipment due to the positioning notch. The positioning notches are preferably designed in the form of recesses or through holes in the frame of the second module. According to the relative position of the positioning notch in relation to the fastening hole, a mating part that fits into the recess is provided in the connecting element. A positioning screw is preferably provided in the connecting element, which screw engages in the positioning notch in the frame of the second module.

An arrangement of the positioning notches offset by 90 degrees has the advantage that an elongate shape is sufficient for the connecting element. Due to the elongate shape of the connecting element, when it is rotated through 90 degrees, an optimal utilization of a contact surface coming to lie on the frame of the first module is achieved.

The connecting element particularly preferably has a rectangular cross section. An approximately rectangular shape has the advantage over an oval or triangular shape, for example, that a ratio of the size of the opening for receiving the connecting element to the contact surface is advantageous after the connecting element has been rotated. The largest possible contact surface is achieved with the smallest possible opening.

In its second position, the connecting element is advantageously provided with a securing device in the form of an adhesive or weld. This prevents loosening of the connection between the two modules due to shocks or operational vibrations of the machine and ensures a secure connection.

For advantageous handling, the connecting elements have an internal thread and a threaded bolt is provided for being fastened in the fastening hole in the frame of the second module. The use of a spring-loaded snap lock is also conceivable. In this case, after the first module has been placed on the second module, the connecting element would be lifted from the frame of the second module against the spring force and, after the rotation, placed on the frame of the first module. The contact pressure and thus the strength of the fastening would in this case be determined by the spring force. Due to possible fatigue of the spring, however, it is preferable to screw the connecting element to the frame of the second module.

To further simplify the assembly or installation of the basic module, it is advantageous if weld nuts are attached to the frame of the second module instead of to the fastening holes and the connecting elements are provided with the threaded bolts in order to install the module on a foundation. If the lowest module is formed by the second module, the connecting element can also be used as a height-adjustable machine base in the proposed construction using a weld nut.

BRIEF DESCRIPTION OF THE DRAWINGS

The invention is described below on the basis of an exemplary embodiment and explained in more detail with the drawings, in which.

DETAILED DESCRIPTION

Figure 1:
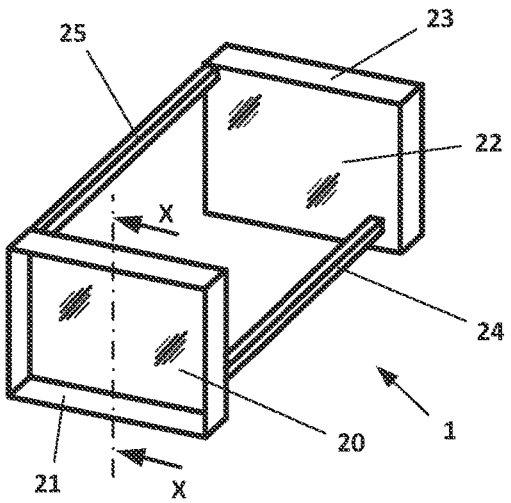
FIG. 1 is a schematic view of a first embodiment of a module.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a module 1 in a first embodiment. In its basic design, the module 1 is constructed from two lateral walls 20 and 22 arranged at a distance from one another. The lateral walls 20 and 22 are connected to one another by cross beams 24 and 25. The lateral walls 20 and 22 are each surrounded by a frame 21 or 23, respectively. The frames 21 and 23 are each attached to a side facing away from the opposite lateral wall 20 and 22 or to the lateral wall 20 and 22, respectively.

Figure 2:
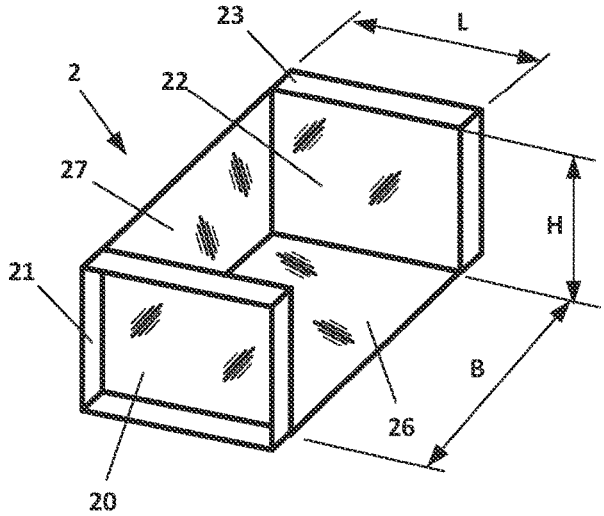
FIG. 2 is a schematic view of a second embodiment of a module.

FIG. 2 shows a schematic view of a module 2 in a second embodiment. The design of the basic elements of the module 2, namely the lateral walls 20 and 21 provided with a frame 21 and 23, is identical to the design according to FIG. 1. The cross beam connecting the lateral walls 20 and 22 is formed in the embodiment shown by a rear wall 27 and a base plate 26. By inserting the rear wall 27 and the base plate 26, a distance between the lateral walls 20 and 22 is established which corresponds to a width B of the module 2. The dimensions of the lateral walls 20 and 22 are identical and determine the length L of the module 2 and the height H of the module 2.

FIGS. 3*a* to 3*d* show a schematic view of a cross section at point X of a module according to FIG. 1 in four alternative embodiments. In all four embodiments, a lateral wall 20 and the associated frame 21 are shown. The embodiments of the frame construction shown can also be used mixed on one module.

Figure 3A:
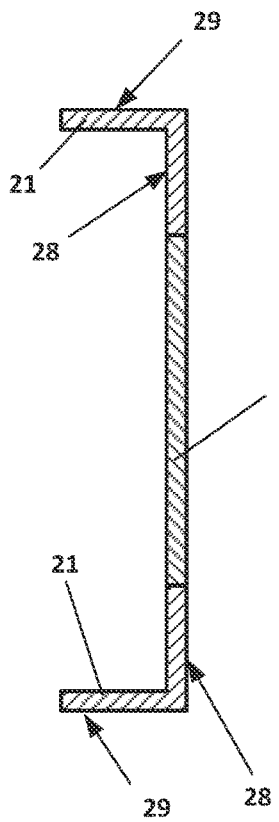
FIG. 3*a-d* are schematic views of a cross section at the point X of a module according to FIG. 1 in three alternative designs.

In FIG. 3*a*, the frame 21 is formed from an isosceles angle iron having a first leg 28 and a second leg 29. The angle iron is placed on the lateral wall 20 and connected to it, for example welded. The first leg 28 forms part of the lateral wall 20 and the actual lateral wall 20 is shortened compared to the embodiments according to FIGS. 3*b* and 3*c*. The height H of the module is achieved by the lateral wall and the first leg 28 of the frame 21.

Figure 3B:
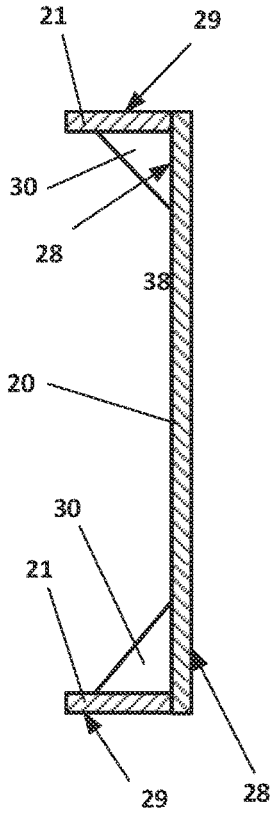

In FIG. 3*b*, however, the frame 21 is formed from flat steel bars and part of the lateral wall 20. The first leg 28 is formed by an outer part of the lateral wall 20 and the second leg 29 corresponds to the flat steel bars. The flat steel bars, or the second leg 29, is connected to the lateral wall 20, for example welded. To increase the stability, ribs 30 are provided which support the flat steel bars on the lateral wall 20. In this embodiment, the dimension of the lateral wall 20 corresponds to the height H of the module.

Figure 3C:
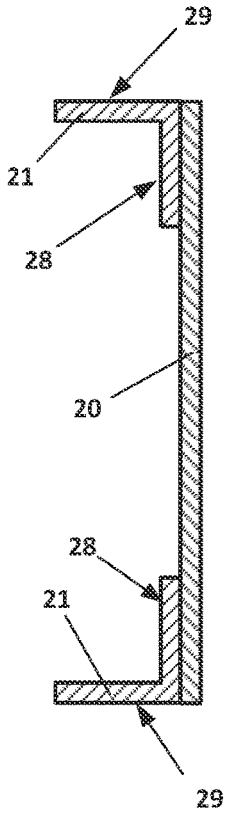

In a further alternative according to FIG. 3*c*, the frame 21 is designed in the form of an angle iron having a first leg 28 and a second leg 29. The angle iron is placed on its first leg 28 on the lateral wall 20 and connected, for example welded, to it, with a screw connection also being possible in this embodiment. In this embodiment, the dimension of the lateral wall 20 corresponds to the height H of the module.

Figure 3D:
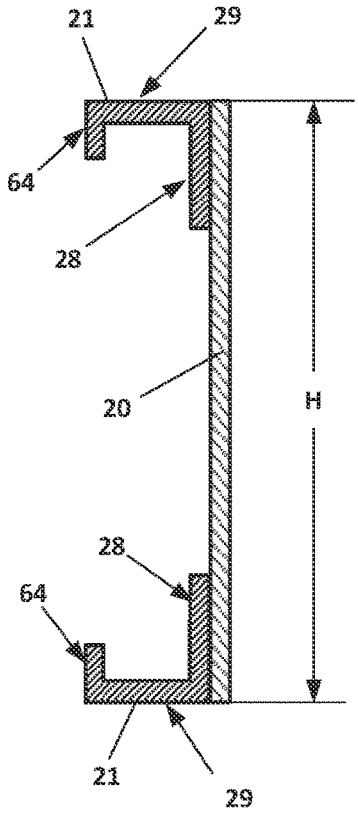

In a further alternative embodiment according to FIG. 3*d*, the frame 21 is placed in the form of a U-profile on the lateral wall 20, which profile forms a first leg 28 and a second leg 29. A third leg 64 adjoining the second leg 29 is formed by the U-profile. In a slightly modified form, the first leg 28 of the U-profile can also be moved into the plane of the lateral wall 20, as shown in FIG. 3*a* using the example of the angle iron. Apart from the increased rigidity of the frame 20 due to the use of the U-profile, there is also a simple possibility of attaching a door to the frame, for example. In this embodiment, the dimension of the lateral wall 20 corresponds to the height H of the module. Further designs, for example in an integral form of lateral wall 20 and frame 21, are conceivable.

Figure 4:
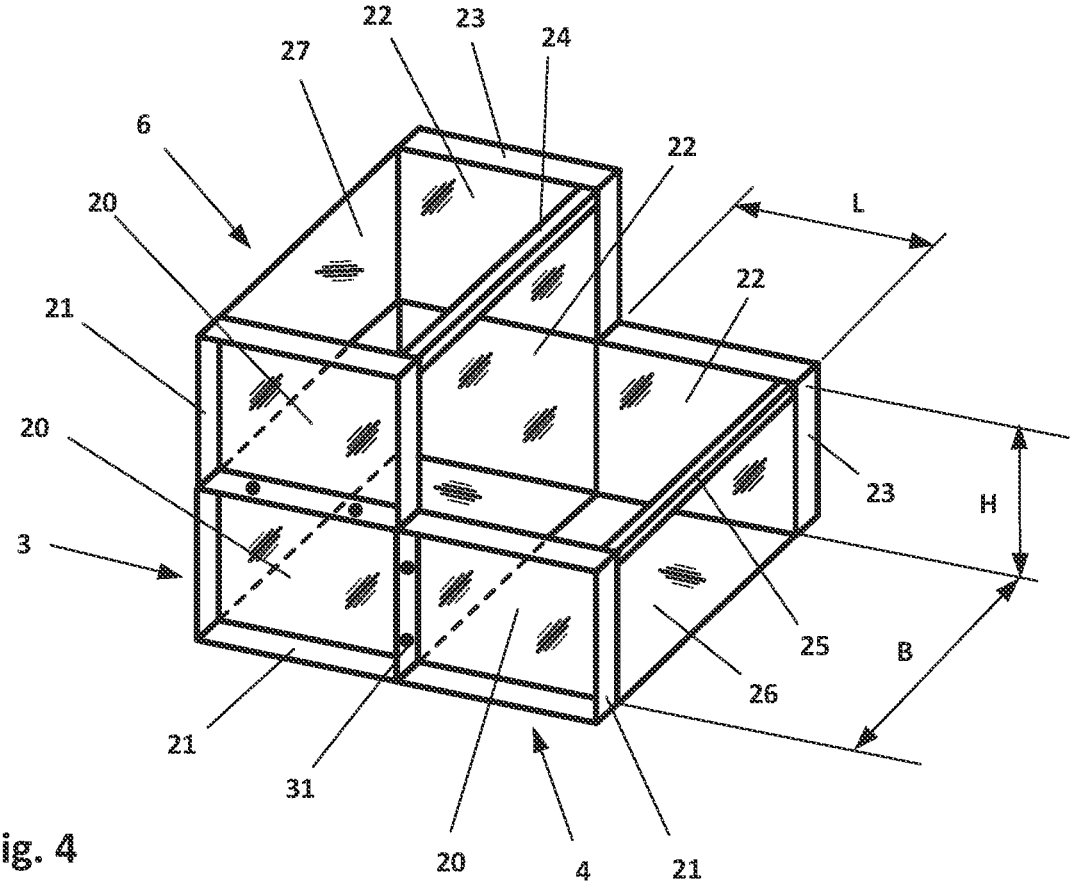
FIG. 4 is a schematic view of an example of a construction of a plurality of modules.

FIG. 4 shows a schematic view of a construction of a plurality of modules 3, 4 and 6 by way of example. All modules 3, 4 and 6 shown have the basic structure of two lateral walls 20, 22 in common, which are provided with a frame 21, 23 in each case and are connected to at least one cross beam. The modules 3, 4 and 6 also each have the same dimensions as width B, height H and length L. The connection with at least one cross beam of the lateral walls 20 and 22 is formed in module 3 by a base plate 26 and a rear wall 27, in module 4 by a rear wall 27 and an angle iron 24 and in module 6 by an angle iron 25 and a base plate 26. The modules 3, 4 and 6 are arranged next to one another and one above the other and are each coupled to a connection 31. The modules 3, 4 and 6, designed as a self-supporting element and connected in this way, form a stable unit and join together to form a machine frame.

Figure 5:
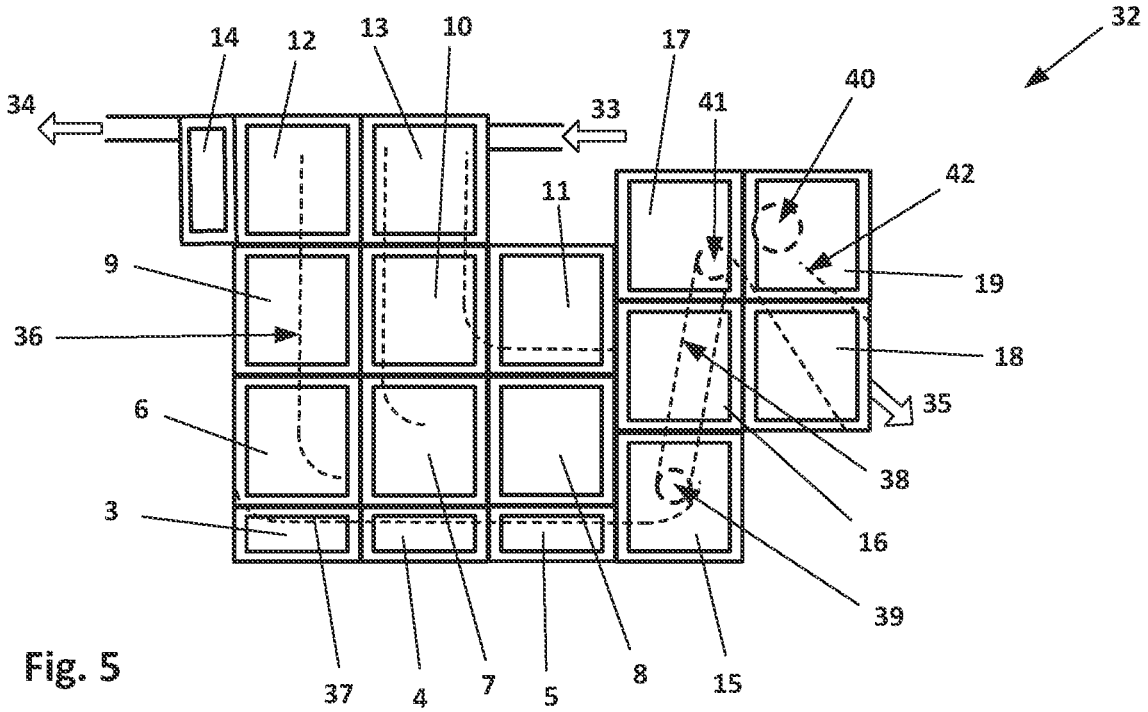
FIG. 5 is a schematic view of a fiber preparation machine made of modules.

FIG. 5 shows a schematic view of a fiber preparation machine constructed from modules 3 to 19 using the example of a mixer 32. The mixer has a fiber material inlet 33 via which the fiber material is guided into the mixer 32 by pneumatic conveying means. The interior of the mixer 32 is divided by chamber walls 36 into a plurality of chambers which receive the incoming fiber material. The transport air required for the pneumatic transport is discharged from the mixer 32 via a transport air outlet 34. The fiber material is removed from the chambers via a conveyor belt 37 below the chambers and fed to a spiked feed lattice 38. The spiked feed lattice 38, which is stretched endlessly around a deflection roller 39 and a drive roller 41, transports the fiber material to an outlet channel 42. Using a discharge roller 40, the fiber material is removed from the spiked feed lattice 38 and guided via the outlet channel 42 to the fiber material outlet 35. The mixer 32 is constructed from modules 3 to 19, the different built-in components such as chamber walls 36, conveyor belt 37, outlet channel 42 being distributed among the corresponding modules. The modules 3 to 19 form the actual machine frame of the mixer 32 to receive the most varied of built-in components and mounted components. The connections of the modules 3 to 19 are designed in such a way that further casing or sealing elements are not necessary. The modules 3, 4, 5 and 15 form the substructure of the mixer 32 and are provided with appropriate elements in order to be installed on a foundation (not shown). The modules 6 to 13 are arranged above the modules 3, 4 and 5 and form the mixing chambers with the chamber walls 36 built therein. The chamber walls 36 are used, for example in the modules 9 and 10, as cross beams so that no further elements are necessary to stabilize the modules 9 and 10. The modules 12 to 14 form the upper end of the mixer 32 and accordingly contain a metal sheet which forms the end of the mixer 32 by forming an upper lateral wall.

In the view shown, the simplicity of assembly due to the design of the modules as self-supporting elements can be seen and the options for expanding the mixer 32 can also be understood. For example, to enlarge the mixing chambers, two further modules which contain corresponding chamber walls 36 can be inserted between the modules 9, 10 and the modules 12, 13. It is not necessary to separate the machine frame. Only the connection between modules 9 and 12 and between 10 and 13 needs to be loosened and the newly added modules need to be connected to the existing modules 9, 10 and 12, 13 accordingly. A further mixing chamber can also be provided by inserting further modules between the modules 6, 7 and 9, 10 and 12, 13.

Figure 6:
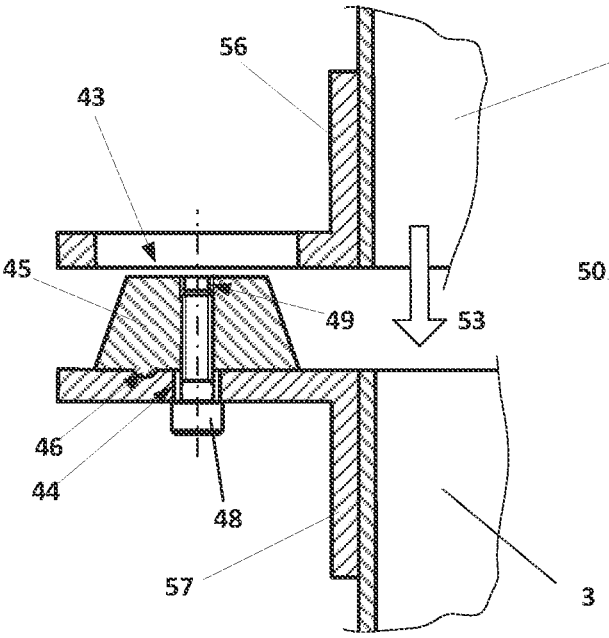
FIG. 6 is a schematic view of a module connection in the assembly position.

FIG. 6 shows a schematic view of a module connection in the assembly position. A first module 6 is arranged above a second module 3 at a distance which corresponds to at least one height of a connecting element 45. The first module 6 has a frame 56 which has an opening 43 in its leg projecting from the first module 6. The second module 3 has a frame 57 which has a fastening hole 44 in its leg projecting from the second module 3. In addition to the fastening hole 44, the frame of the second module 3 also has a first positioning notch 46. The connecting element 45 is fastened to the frame 57 of the second module 3 in the fastening hole 44 by means of a threaded bolt 48. The connecting element 45 has a mating part which matches the first positioning notch 46 of the frame 57 and engages in the first positioning notch 46 in the fastened position. The connecting element 45 likewise has an internal thread 49 into which the threaded bolt 48 is screwed. The connecting element 45 has a cross section which, starting from the frame 57 of the second module 3, tapers toward the frame 56 of the first module 6. The opening 43 in the frame 56 of the first module 6 corresponds to the dimension of the connecting element 45 at the point at which the connecting element 45 abuts the frame 57 of the second module 3. After the first module 6 has been positioned above the second module 3, the first module 6 is lowered onto the second module 3 in the direction of an assembly movement 53. The connecting element 45 is guided through the opening 43 and the first module 6 slides, guided by the shape of the connecting element 45, into the exact position.

Figure 7:
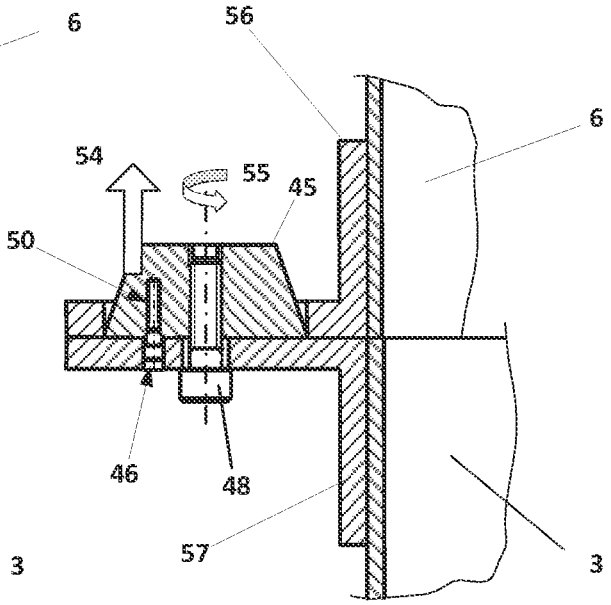
FIG. 7 is a schematic view of a module connection in the transition from an assembly position to an operating position.

FIG. 7 shows a schematic view of a module connection in the transition from an assembly position to an operating position. After the assembly movement 53 has been carried out (see FIG. 6), the frame 56 of the first module 6 comes to rest on the frame 57 of the second module 3. In the embodiment shown according to FIG. 7, the first positioning notch 46 is formed by a through opening in the frame 57 of the second module 3. A positioning screw 50 is provided on the connecting element 45, the screw head of which engages in the through opening or first positioning notch 46. As a result, the threaded bolt 48 is released and the connecting element 45 is raised in the direction of arrow 54. After the connecting element 45 has been raised over the frame 56 of the first module 6, the connecting element 45 is rotated in the direction of the arrow 55. The rotation 55 of the connecting element 45 is guided until the positioning screw 50 engages in a second positioning notch 47 (see FIG. 9). After tightening the threaded bolt 48, the operating position of the module connection is as shown in FIGS. 8 and 9.

Figure 8:
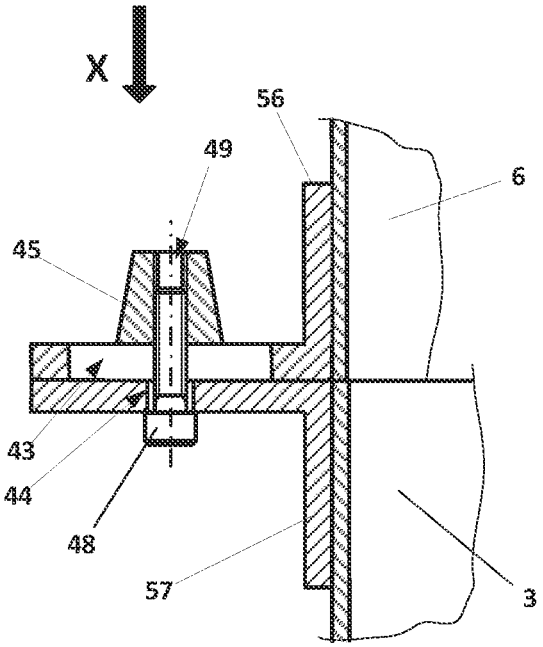
FIG. 8 is a schematic view of a module connection in the operating position.
Figure 9:
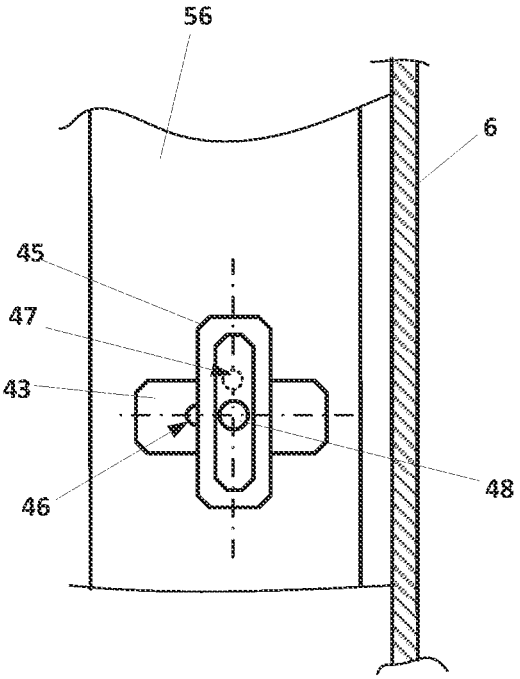
FIG. 9 is a schematic view of a plan view in direction X of a module connection in the operating position according to FIG. 8.

FIG. 8 shows a schematic view of a module connection in the operating position and FIG. 9 shows a plan view in the direction X according to FIG. 8. The frame 56 of the first module 6 is braced to the frame 57 of the second module 3 via the connecting element 45 and the threaded bolt 48 which engages in the internal thread 49 of the connecting element 45 and guides the fastening hole 44. In FIG. 9, the connecting element 45 is shown having a rectangular cross section which corresponds to a cross section of the opening 43 in the frame 56 of the first module 6. As a result of the rotation of the connecting element 45, a large part of a contact surface of the connecting element 45 comes into contact with the frame 56 of the first module 6. Also shown are first positioning notches 46 and second positioning notches 47 which are offset by 90 degrees, are used for simple assembly and defined positioning of the connecting element 45 when it is fastened by the threaded bolt 48 on the frame 57 of the second module 3 or for bracing the two frames 56 and 57.

Figure 10:
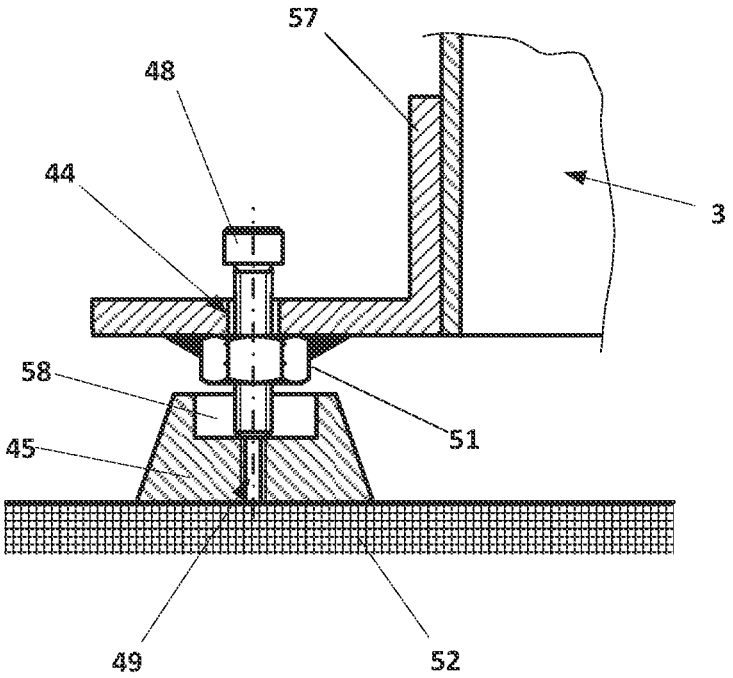
FIG. 10 is a schematic view of a module installation.

FIG. 10 shows a schematic view of a module installation on a foundation 52 with the use of a connecting element 45. A weld nut 51 is provided, centrally to a fastening hole 44, on the frame 57 of the second module 3 so as to be directed toward the foundation 52, the weld nut 51 being rotationally connected to the frame 57 by means of a welded joint. The connecting element 45 is arranged on a side of the frame 57 facing away from the second module 3 or on a side facing the foundation 52. The threaded bolt 48 is guided through the weld nut 51 into a recess 58 in the connecting element 45. As a result of this contact of the connecting element 45, the height of the frame 57 relative to the foundation 52 can be adjusted in a simple manner and the connecting elements 45 can be used as machine feet. The internal thread 49 arranged in the connecting element 45 comes to rest on a side of the connecting element 45 facing the foundation 52, as a result of which identical connecting elements 45 can be used for installation on a foundation 52 as well as for bracing the individual modules 3 and 6 against one another. The recess 58 shown is used to receive the weld nut 51 in the case of a low installation and also to center the threaded bolt 48 when the connecting element 45 is used as a machine foot. The recess 58 is not shown in FIGS. 6 to 9, but it can also be present. This does not lead to a disadvantage, since the contact surface between the connecting element 45 and the frame 56 of the first module 6 is located on the side of the connecting element 45 facing away from the recess 58.

Figure 11:
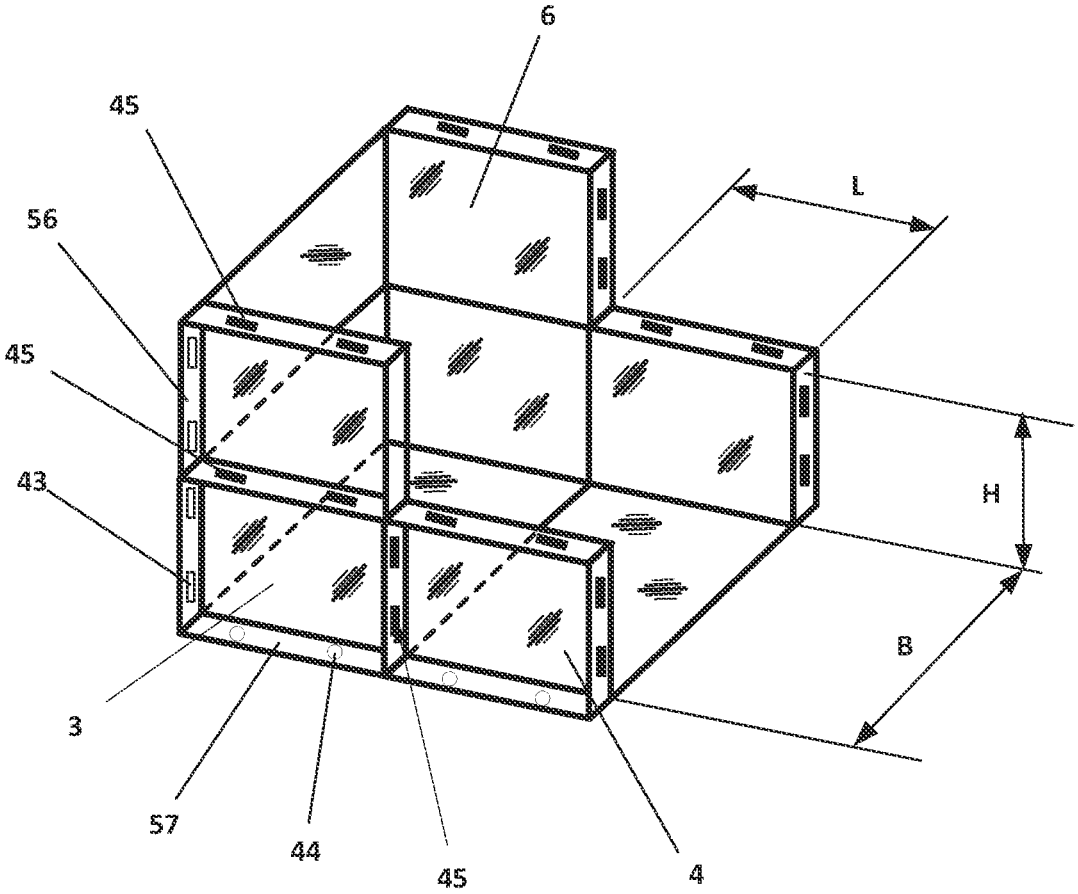
FIG. 11 is a schematic view of an assembly of a plurality of modules.

FIG. 11 shows a schematic view of an assembly of a plurality of modules which are held together by connecting elements 45. The first module 6 is arranged above the second module 3. A third module 4 is located to the side of the second module 3. The frame 56 of the first module 6 is connected to the frame 57 of the second module 3 and a frame of the third module 4 is connected to the frame 57 of the second module 3. The connections are carried out by means of connecting elements 45 with which each of the frames are braced against one another. Furthermore, the frame 57 of the second module 3 has openings 43 for fastening further modules and fastening holes 44 for fastening connecting elements 45 in the function of machine feet. The modules are shown schematically and without built-in components or attachments; depending on the machine, different units and apparatuses, for example rollers, drives, guide plates, sensors, etc., are built into or attached to the modules. The dimensions of the modules, i.e., their width B, height H and length L, are advantageously selected to be the same size, but in such a way that the transport size is favorable. The module width B advantageously corresponds to a working width of the machine, as a result of which the lateral walls of the modules simultaneously represent the lateral delimitation of the machine.

Figure 12:
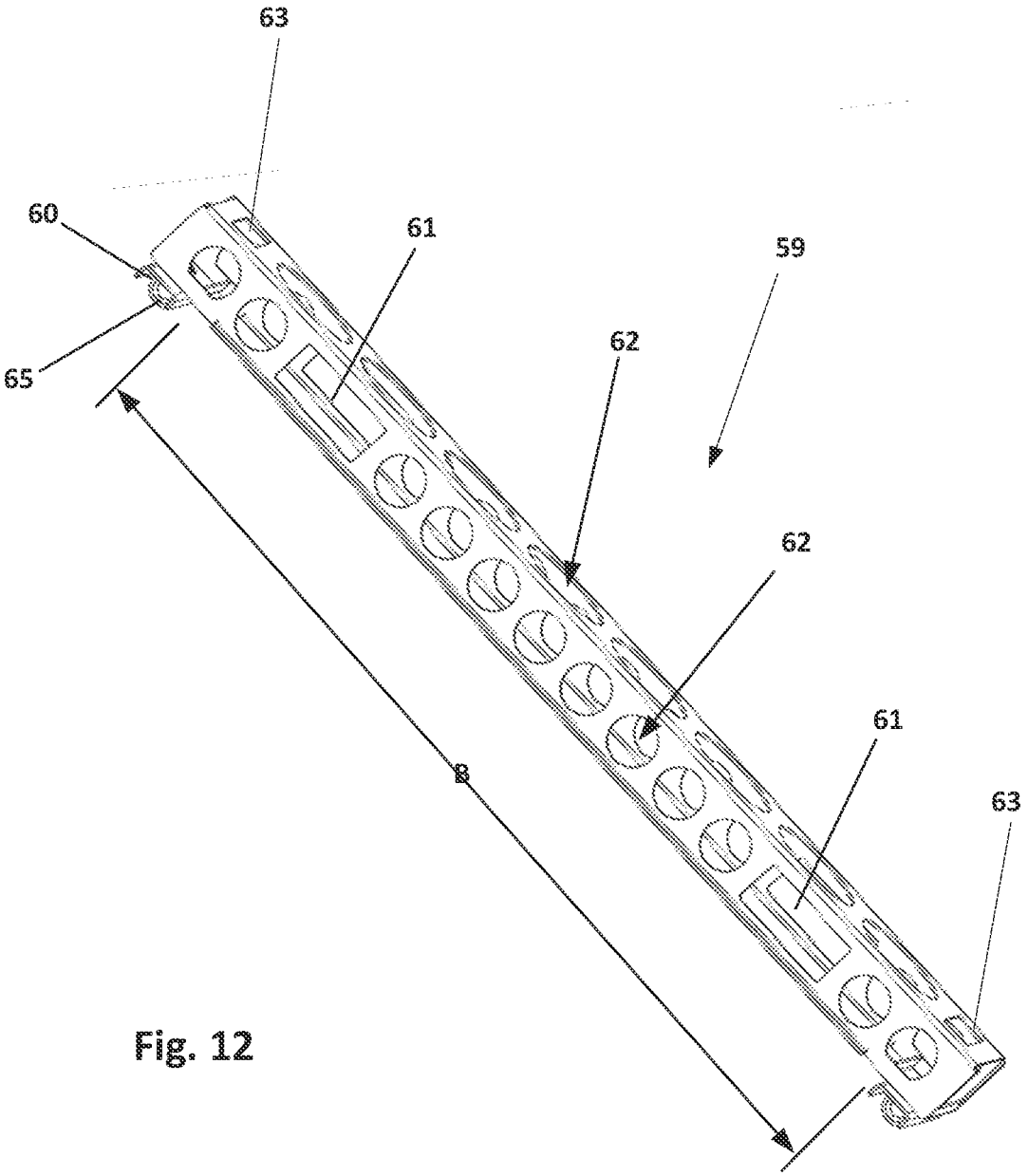
FIG. 12 is a schematic view of a lifting arm.

FIG. 12 shows a schematic view of a lifting arm 59. The lifting arm 59 spans the width B of a module and is fastened to it by two plates 60 and eye bolts 65. The lifting arm 59 is placed on a module so that the ends of the lifting arm 59 come to rest on the frame of the module. The plate 60 is inserted on the side of the leg of the frame which is opposite the lifting arm 59 and on which the lifting arm 59 rests and is screwed to the lifting arm 59 by means of the eye bolt 65 through an opening in the frame. Two receptacles 61 are provided in the lifting arm 59, which receptacles can be used to transport the module by means of a forklift truck. Loops or ropes can also be passed through the receptacles for transporting the module using a crane. For simple manual handling of the lifting arm 59 alone, a handle 63 is provided at each end of the lifting arm 59. The lifting arm 59 can thus be moved manually. Recesses 62 are arranged over the entire length of the lifting arm 59, which recesses are only used to reduce the weight of the lifting arm 59.

The present invention is not limited to the embodiments shown and described. Modifications within the scope of the claims are possible, as is a combination of the features, even if these are shown and described in different embodiments.

LIST OF REFERENCE SIGNS

1-19 Module
20 First lateral wall
21 Frame of first lateral wall
22 Second lateral wall
23 Frame of second lateral wall
24 First cross beam
25 Second cross beam
26 Base plate
27 Rear wall
28 First leg
29 Second leg
30 Rib
31 Connection
32 Mixer
33 Fiber material inlet
34 Transport air outlet
35 Fiber material outlet
36 Chamber wall
37 Conveyor belt
38 Spiked feed lattice
39 Deflection roller
40 Discharge roller
41 Drive roller
42 Outlet channel
43 Opening
44 Fastening hole
45 Connecting element
46 First positioning notch
47 Second positioning notch

48 Threaded bolt
49 Internal thread
50 Positioning screw
51 Weld nut
52 Foundation
53 Assembly movement
54 Raise connecting element
55 Rotate connecting element
56 Frame of first module
57 Frame of second module
58 Recess
59 Lifting arm
60 Plate
61 Receptacle
62 Recess
63 Handle
64 Third leg
65 Eye bolt
L Length of the module
B Width of the module
H Height of the module

The invention claimed is:

1. A fiber preparation machine, comprising: a plurality of modules, each module comprising:

a cuboid shape having a length (L), a width (B) and a height (H);

opposite and parallel lateral walls spaced apart by the width (B), the lateral walls having a rectangular shape defining the length (L) and height (H) of the cuboid shape;

a cross beam connecting the lateral walls to one another, the cross beam defining the width (B) of the cuboid shape;

each of the lateral walls encompassed by a continuous and unbroken frame around the length (L) and height (H);

wherein at each of the lateral walls a first leg of the frame is arranged along a plane of the lateral wall and a second leg of the frame is arranged at a right angle to the plane of the lateral wall and faces away from the opposite lateral wall; and wherein adjacent ones of the plurality of modules are assembled together via connection of the second legs along the length (L) or height (H) of the adjacent ones of the plurality of modules such that the connected second legs are continuous and unbroken along an entirety of the assembled modules.

2. The fiber preparation machine according to claim 1, wherein for each of the plurality of modules the frame is formed by one of: flat steel bars; an angle iron; or a U-profile shaped member.

3. The fiber preparation machine according to claim 1, wherein for each of the plurality of modules the cross beam is formed by one of: an angle iron; a pipe; a metal sheet; or a roller.

4. The fiber preparation machine according to claim 1, wherein for each of the plurality of modules the width (B) is from 1,200 to 1,800 mm.

5. The fiber preparation machine according to claim 1, wherein one or more of the plurality of modules further comprises a rear wall extending between the opposite and parallel lateral walls.

6. The fiber preparation machine according to claim 1, wherein for each of the plurality of modules the second leg of the frame is connected to one of the lateral walls in a dust-tight manner.

7. The fiber preparation machine according to claim 1, wherein each of the plurality of modules further comprises a lifting arm configured for quick-release fastening to the frame, the lifting arm comprising eyebolts or receptacles engageable by a fork of a forklift truck to transport each of the plurality of modules.

8. The fiber preparation machine according to claim 1, wherein the second legs are connected by one of: a clamp connection; a screw connection; or a weld connection.

9. The fiber preparation machine according to claim 8, wherein the clamp connection comprises a clip with locking connecting elements.

10. The fiber preparation machine according to claim 1, further comprising a seal between the connected second legs of the adjacent ones of the plurality of modules.

11. The fiber preparation machine according to claim 1, wherein a defined number of the plurality of modules form a fiber conveying duct in the fiber preparation machine for fiber flow and are 50 mm to 100 mm narrower in width (B) than adjacent modules.

12. The fiber preparation machine according to claim 1, the fiber preparation machine comprising a working width that corresponds to the width (B) of the plurality of modules.

13. The fiber preparation machine according to claim 1, further comprising:

a first one of the plurality of modules comprising an opening in the frame for receipt of a connecting element;

a second one of the plurality of modules comprising a fastening hole in the frame and first and second positioning notches offset from one another by at least 45 annular degrees around the fastening hole;

the connecting element rotatably attached to the frame of the second one of the plurality of modules with a bolt through the fastening hole;

wherein in an assembly position, the connecting element is at a first rotated position and is prevented from rotating by engagement in the first positioning notch and is insertable through the opening in the first one of the plurality of modules;

wherein in an operating position, the connecting element extends through the opening in the first one of the plurality of modules and is at a second rotated position and is prevented from rotating by engagement in the second positioning notch; and wherein in the operating position, the first one of the plurality of modules is connected to the second one of the plurality of modules by bracing the frame of the first one of the plurality of modules between the connecting element and the frame of the second one of the plurality of modules.

* * * * *